US007520049B2

(12) United States Patent
Kim

(10) Patent No.: US 7,520,049 B2
(45) Date of Patent: Apr. 21, 2009

(54) METHOD FOR MANUFACTURING A PLANAR RESISTANCE HEATING ELEMENT

(75) Inventor: Gyongtae Kim, Seoul (KR)

(73) Assignee: Suntech Co., Ltd., Seoul (KR)

( * ) Notice: Subject to any disclaimer, the term of this patent is extended or adjusted under 35 U.S.C. 154(b) by 280 days.

(21) Appl. No.: 11/283,798

(22) Filed: Nov. 22, 2005

(65) Prior Publication Data

US 2007/0007269 A1 Jan. 11, 2007

(30) Foreign Application Priority Data

Jul. 6, 2005 (KR) ..... 10-2005-0060568

(51) Int. Cl.
*H01C 17/28* (2006.01)

(52) U.S. Cl. ..... 29/621; 29/610.1; 29/611; 29/620; 29/825; 29/829; 29/846; 29/847; 205/219; 205/260; 205/505; 438/612; 438/652

(58) Field of Classification Search ..... 29/621, 29/610.1, 611, 620, 825, 829, 846, 847; 205/98, 205/201; 219/219, 260, 505; 438/612, 652
See application file for complete search history.

(56) References Cited

U.S. PATENT DOCUMENTS 4,132,813 A * 1/1979 Schaal ..... 438/612
4,225,398 A * 9/1980 Hasegawa et al. ..... 205/98
4,628,187 A 12/1986 Sekiguchi et al.
4,761,541 A 8/1988 Batliwalla et al.
4,857,711 A 8/1989 Watts
4,931,627 A 6/1990 Watts
5,015,824 A 5/1991 Monter et al.
5,155,334 A 10/1992 Marstiller et al.
5,440,425 A 8/1995 Kadooka et al.
5,446,576 A 8/1995 Lynam et al.
5,716,536 A 2/1998 Yokoto et al.

* cited by examiner

*Primary Examiner*—Thiem Phan
(74) *Attorney, Agent, or Firm*—Nixon & Vanderhye PC

(57) ABSTRACT

Disclosed herein is a manufacturing method of a planar resistance heating element and a planar resistance heating element made using the method. In the manufacturing method of a planar resistance heating element by etching an aluminum foil deposited on an insulating substrate in a desired pattern, printing carbon paste and connecting current input terminals in parallel, the aluminum foil is adapted to undergo a multiple step tempering process to thereby prevent heat deformation. The carbon paste acting as a resistor element is made of electrically conductive carbon, graphite, a resin, a solvent and a hardener which are mixed so as to optimize physical properties of the carbon paste. As a result, prevention of heat deformation of the insulating substrate, uniform heat conductivity, excellent heat-generation effect and easy manufacture may be achieved. In addition, the use of the carbon paste having optimized physical properties as a resistor element results in good heat-generation and near-zero temperature variation.

2 Claims, 3 Drawing Sheets

METHOD FOR MANUFACTURING A PLANAR RESISTANCE HEATING ELEMENT

CROSS-REFERENCE TO RELATED DOCUMENT

This application claims priority based on Republic of Korea Patent Application No. 10-2005-0060568 filed on Jul. 6, 2005.

BACKGROUND OF THE INVENTION

1. Field of the Invention

The present invention relates to a manufacturing method of a planar resistance heating element wherein an aluminum foil deposited on an insulating substrate is etched in a desired pattern, carbon paste is printed and then current input terminals are connected in parallel, and to a planar resistance heating element made using the manufacturing method. More particularly, the present invention relates to a manufacturing method of a planar resistance heating element wherein an aluminum foil acting as an electrode layer deposited on an insulating substrate is tempered in multiple steps to prevent heat deformation and a resistor element is formed using carbon paste made of a mixture of thermally conductive carbon, graphite, a resin, a solvent and a hardener, and to a planar resistance heating element made using the manufacturing method.

2. Description of the Prior Art

A planar resistance heating element is a heater which uses far infrared rays radiated from an insulated planar radiator heated by conduction heat generated from a resistance heating element embedded in the radiator. The resistance heating element may be made of metallic thin plates, surface treated metallic oxides, ceramic plates, carbon black, or carbon fibers.

Among conventional planar resistance heating elements, one heating element that does not have a positive temperature coefficient (PTC) resistor element generates heat using direct current, has low resistance and conducts a large amount of electric current, thereby complicating temperature control. Another heating element having electric current directly applied thereto without separate electrodes has non-uniform electric conductivity. In yet another heating element comprising electrodes and a resistor element, the electrodes are formed through mixing powder of a metal such as silver with a resin and printing the metallic mixture, the resistor element is formed through mixing a carbon-based material with a resin and printing the carbon mixture, and electric current is then applied to the resistor element to generate heat. Although silver is an excellent electric conductor, it is silver paste made of a mixture of a synthetic resin and silver powder that is used in a planar resistance heating element, resulting in poor electric conductivity. Further, a complex and expensive manufacturing process is needed.

To solve these problems, the inventor of the present invention has developed a manufacturing method of a planar resistance heating element (Korean Patent No. 411401), which comprises the steps of: printing an etch-resist in a desired pattern on an aluminum foil deposited on an insulating substrate; spraying an etchant on the aluminum foil to cause a portion of the aluminum foil, where the etch-resist is not printed, to corrode away; cleaning the etch-resist and etchant using an alkaline solution; printing in a desired pattern using carbon paste; and connecting current input terminals in parallel to an electrode layer of the aluminum foil.

However, there are some unsolved problems in the manufacture of a planar resistance heating element. A polyethylene terephthalate (PET) film, which is typically used as an insulating substrate, may be deformed owing to heat, causing irregular printing in a manufacturing process or non-uniform heat conduction after the manufacturing process. Additionally, in the manufacture of the carbon paste acting as a resistor element, an improper composition ratio between electrically conductive carbon, a resin, a solvent and a hardener in the carbon paste may deteriorate physical properties including heat-generating properties.

SUMMARY OF THE INVENTION

In the manufacture of a planar resistance heating element having uniform conductivity and excellent heat-generating properties, the inventors of the present invention have endeavored to solve the problem of non-uniform printing of carbon paste owing to heat deformation in a manufacturing process or non-uniform heat conductivity after the manufacturing process, and optimize physical properties including heat-generating properties of the carbon paste acting as a resistor element. The inventors have found that the heat deformation can be prevented through tempering an aluminum foil deposited on an insulating substrate in multiple steps. It has also been found that a planar resistance heating element having uniform heat conductivity and excellent heat-generation effect can be manufactured by using the carbon paste acting as a resistor element which is made of constituent materials mixed in an optimized composition ratio for physical properties of the carbon paste.

Accordingly, an object of the present invention is to provide a manufacturing method of a planar resistance heating element and a planar resistance heating element made using the method, wherein uniform heat conductivity, excellent heat-generation effect and easy manufacture through prevention of heat deformation in an insulating substrate can be achieved.

Another object of the present invention is to provide a manufacturing method of a planar resistance heating element and a planar resistance heating element made using the method, wherein a resistor element is made of carbon paste of electrically conductive carbon, graphite, a resin, a solvent and a hardener mixed in a ratio for optimizing physical properties of the resistor element, leading to good conductivity and near-zero temperature variation.

Yet another object of the present invention is to provide a manufacturing method of a planar resistance heating element and a planar resistance heating element made using the method, wherein low-resistance carbon paste and high-resistance carbon paste are mixed to produce a resistor element having a desired resistance, permitting easy selection of desired heat-generating properties.

In a manufacturing method of a planar resistance heating element by etching an aluminum foil deposited on an insulating substrate in a desired pattern, printing carbon paste and connecting current input terminals in parallel, the present invention provides etching after tempering the aluminum foil deposited on the insulating substrate in a stepwise manner. Preferably, the carbon paste acting as a resistor element is made of a mixture of electrically conductive carbon, graphite, a resin, a solvent and a hardener.

Preferably, the carbon paste is a mixture of low-resistance carbon paste and high-resistance carbon paste, providing a desired resistance.

Preferably, the low-resistance carbon paste is a mixture of the electrically conductive carbon, graphite, a resin and a solvent, and the high-resistance carbon paste is a mixture of the electrically conductive carbon, graphite, a resin, a solvent and a hardener.

In accordance with another aspect of the present invention, there is provided a planar resistance heating element made using the manufacturing method.

DETAILED DESCRIPTION OF THE INVENTION

Hereinafter, the present invention will be described in detail with reference to the accompanying drawings.

Figure 1:
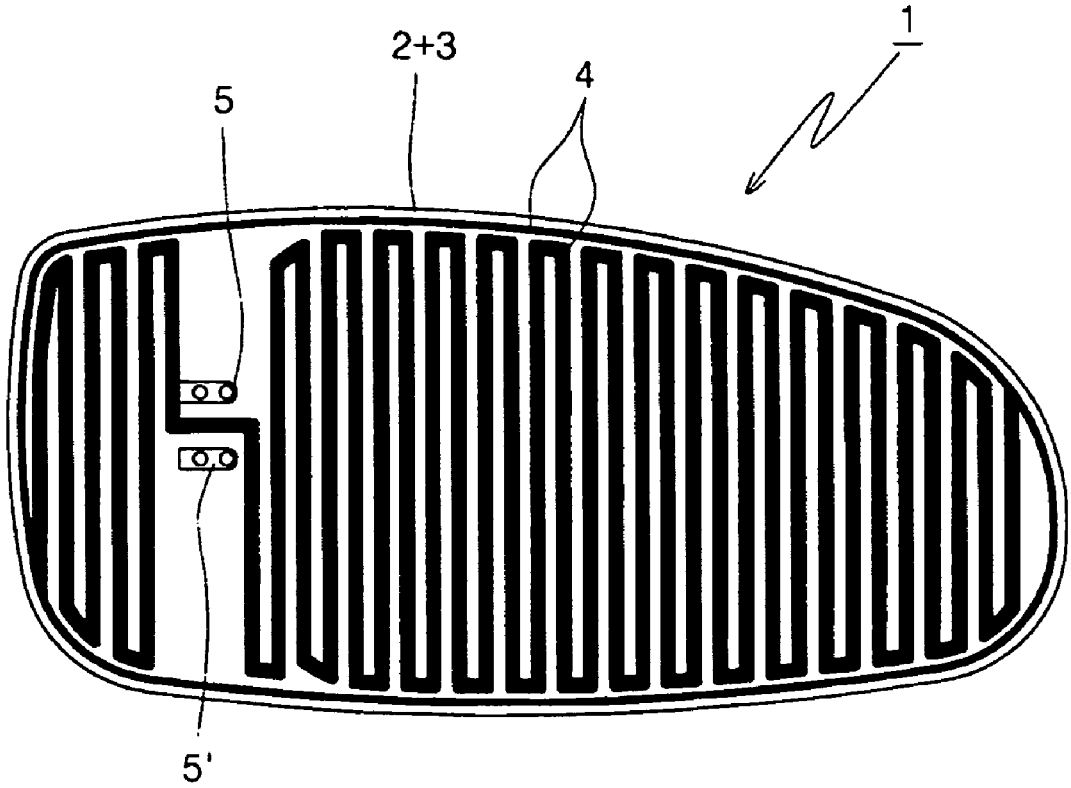
FIG. 1 is a plan view showing a planar resistance heating element according to the present invention.
Figure 2:
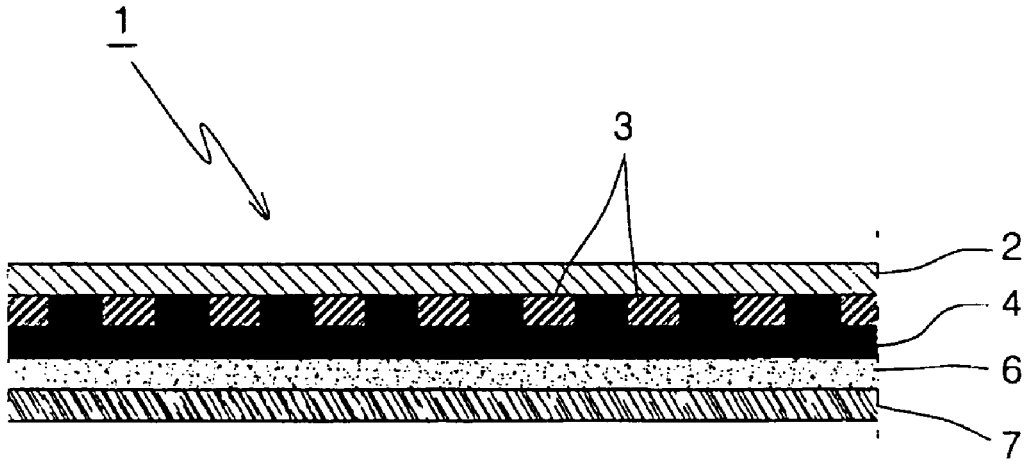
FIG. 2 is a sectional view showing the planar resistance heating element according to the present invention.

FIG. 1 is a plan view showing a planar resistance heating element according to the present invention, and FIG. 2 is a sectional view showing the planar resistance heating element. Referring to FIGS. 1 and 2, the planar resistance heating element 1 according to the present invention comprises an insulating substrate 2, aluminum foil 3, carbon paste 4, and current terminals 5 and 5'.

In the planar resistance heating element 1, the aluminum foil 3 deposited on the insulating substrate 2 is used as an electrode layer. The insulating substrate 2 should be compatible with a resin constituting the carbon paste 4 which is a resistor element. For this reason, it is preferable that the insulating substrate 2 is made of a PET sheet.

According to the present invention, the aluminum foil 3 deposited on the insulating substrate 2 is adapted to undergo a tempering process to prevent heat deformation of the insulating substrate 2 during printing and drying operations in the manufacture of the planar resistance heating element 1. This heat deformation may cause problems of non-uniform printing of the carbon paste and non-uniform heat conduction. It is preferable that the tempering process is performed in multiple steps in viewpoints of a processing time, energy consumption, and heat deformation prevention. That is, it is preferable that the aluminum foil 3 is tempered in multiple steps at a temperature of 0 to 40° C. for 1.5 to 2.5 hours, at a temperature of 40 to 70° C. for 1.5 to 2.5 hours, at a temperature of 70 to 100° C. for 2.5 to 3.5 hours, and at a temperature of 100 to 130° C. for 14 to 18 hours. It is more preferable to perform the multiple step tempering at a temperature of 0 to 40° C. for 2 hours, at a temperature of 40 to 70° C. for 2 hours, at a temperature of 70 to 100° C. for 3 hours, and at a temperature of 100 to 130° C. for 16 hours. The tempered aluminum foil 3 deposited on the insulating substrate 2 does not show heat deformation in printing and drying operations described later, and uniform printing of carbon paste and uniform heat conduction in the planar resistance heating element 1 can be obtained.

After tempering, the aluminum foil 3 deposited on the insulating substrate 2 is adapted to undergo cleaning and drying operations for easy printing and etching. It is preferable that the aluminum foil 3 is cleaned using a cleansing solution of pH 10 to 12 at a speed of 3.3 to 3.4 m/min. After cleaning, it is preferable that the aluminum foil 3 is dried at a temperature of 50 to 65° C.

After cleaning and drying, an etch-resist is printed in a desired pattern on the aluminum foil 3 deposited on the insulating substrate 2, and dried. The etch-resist is not limited to a particular one, and may be a commercially available heat or ultraviolet (UV) etch-resist. The etch-resist may be heat-dried or UV-dried. It is preferable that the etch-resist is UV-dried at a temperature of 85 to 89° C. for 10 to 20 seconds.

Afterwards, a portion of the aluminum foil 3 which is not protected by the etch-resist is corroded away. At this time, an acid such as ferric chloride ($Fe_2Cl_3$) may be used. The etch-resist is then removed using an alkaline solution such as sodium hydroxide (NaOH). After the above treatment, only an electrode pattern made of the aluminum foil 3 remains on the insulating substrate 2.

According to the present invention, the carbon paste 4 is used as a resistor element. The carbon paste 4 is made of a mixture of electrically conductive carbon, graphite, a resin, a solvent and a hardener. The carbon constituting the carbon paste 4 may be any electrically conductive carbon, and preferably, be an electrically conductive carbon having a good thermally conductivity mixed with graphite, which is commercially available. The resin constituting the carbon paste 4 may be any resin that has a low heat-deformation rate, mixes well with the carbon, is adhesive and water-insoluble. For example, the resin may be polyester, polyacrylate or polyamide resin, and the polyester resin is most preferred. As described above, because a preferred resin for the carbon paste 4 is the polyester resin, it is preferable that the insulating substrate 2 is made of a PET sheet having proper compatibility with the polyester resin. The solvent may be butyl cellosolve acetate or butyl carbitol acetate, and the butyl carbitol acetate is preferred. The hardener may be a widely used one, and polyisocyanate is preferred. The constituents of the carbon paste 4 are mixed in a composition ratio such that physical properties of the carbon paste 4 acting as a resistor element are optimized. Thus, the planar resistance heating element 1 of the present invention has good heat-generating effect and near-zero temperature variation.

Furthermore, the carbon paste 4 may be formed by mixing low-resistance carbon paste and high-resistance carbon paste to produce a resistor element having a desired resistance, permitting easy selection of desired heat-generating properties. The low-resistance carbon paste comprises electrically conductive carbon, graphite, a resin and a solvent. The high-resistance carbon paste further comprises a hardener in addition to those constituents of the low-resistance carbon paste.

The low-resistance carbon paste has a composition of 15 to 25 weight parts of the electrically conductive carbon, 5 to 15 weight parts of the graphite, 15 to 25 weight parts of the resin, and 40 to 50 weight parts of the solvent. The high-resistance carbon paste has a composition of 10 to 15 weight parts of the electrically conductive carbon, 5 to 10 weight parts of the graphite, 25 to 30 weight parts of the resin, 40 to 50 weight parts of the solvent, and 2 to 5 weight parts of the hardener.

Preferably, the high-resistance carbon paste having the composition described above is rolled and aged at a temperature of 100 to 150° C. for 40 to 48 hours, and is rolled again and aged at a temperature of 100 to 120° C. for 12 to 24 hours before use.

Although a single type of carbon paste may be used theoretically to provide a resistor element having a desired resistance, it is preferable in practice to mix low-resistance carbon paste and high-resistance carbon paste to provide a resistor element having a desired resistance. The composition ratio between the low-resistance carbon paste and the high-resistance carbon paste may vary depending upon the desired resistance. Preferably, 5 to 20 weight parts of the low-resistance carbon paste and 80 to 95 weight parts of the high-resistance carbon paste are mixed.

The carbon paste 4, which is mixed so as to have a predetermined resistance, is printed on the aluminum foil 3 having the electrode pattern printed thereon, and dried at a temperature of 110 to 130° C. for 3 to 10 minutes.

Afterwards, the current input terminals 5 and 5' are connected in parallel, and silicone may be coated thereon. Although the planar resistance heating element 1 made as described above can be utilized as it is, an adhesive or double-sided adhesive tape may be coated on the carbon paste 4 to form an adhesive layer 6, and a release paper 7 may be attached on the adhesive layer 6, for the convenience of product distribution or the user.

In the planar resistance heating element 1 of the present invention, the aluminum foil 3 deposited on the insulating substrate 2 is adapted to undergo a multiple step tempering process to prevent heat deformation, leading to uniform printing of the carbon paste 4 and uniform heat conductivity. In addition, the electrically conductive carbon, graphite, a resin, a solvent and a hardener are mixed so as to optimize physical properties such as heat-generating properties of the carbon paste 4 acting as a resistor element. Consequently, the planar resistance heating element 1 having good heat-generating effect may be manufactured with ease and at low cost. Further, the low-resistance carbon paste and high-resistance carbon paste can be mixed to produce a desired resistance, permitting a variety of heat-generating properties.

Hereinafter, the present invention will be described in detail with reference to the following embodiments, which are not intended to limit the scope of the invention.

EXAMPLE

A PET sheet having a commercially available aluminum foil deposited thereon (ratio of PET to aluminum=125:9, thickness of 9.0 μm) is tempered stepwise at a temperature of 0 to 40° C. for 2 hours, at a temperature of 40 to 70° C. for 2 hours, at a temperature of 70 to 100° C. for 3 hours, and at a temperature of 100 to 130° C. for 16 hours. The tempered PET sheet is cleaned using a cleansing solution of pH 10 and dried at a temperature of 45 to 65° C. A commercially available etch-resist (AS-500, Daiyo Ink Co., Korea) is printed in a desired pattern on the aluminum foil, and UV-dried at a temperature of 85° C. for 12 seconds. Afterwards, a portion of the aluminum foil which is not protected by the etch-resist is corroded away using 5% hydrochloric acid (HCl) solution, and washed with water. The aluminum foil is then processed using 2% sodium hydroxide (NaOH) solution.

Low-resistance carbon paste and high-resistance carbon paste is mixed to form carbon paste acting as a resistor element. The low-resistance carbon paste is a mixture of 20 weight parts of electrically conductive carbon (SEAST 3H, Tokai Carbon Co., Japan), 10 weight parts of graphite (Nippon Graphite Industrial Co., Japan), 25 weight parts of co-polyester resin (SKYBONES-300, SK Chemical Co., Korea), and 45 weight parts of butyl carbitol acetate. The high-resistance carbon paste is a mixture of 15 weight parts of electrically conductive carbon (SEAST 3H, Tokai Carbon Co., Japan), 5 weight parts of graphite (Nippon Graphite Industrial Co., Japan), 25 weight parts of co-polyester resin (SKYBON ES-300, SK Chemical Co., Korea), 50 weight parts of butyl carbitol acetate, and 5 weight parts of a hardener (BURNOCK DN-980S, Aekyung Chemical Co., Korea). The high-resistance carbon paste is rolled and aged at a temperature of 120° C. for 40 hours, and is rolled again and aged at a temperature of 100° C. for 24 hours. About 40 g of the low-resistance carbon paste and about 400 g of the high-resistance carbon paste are mixed to form the carbon paste having a resistance of 8 to 10 ohms. The carbon paste is printed in a thickness of 5 to 7 μm on the aluminum foil having an electrode pattern printed thereon, and dried at a temperature of 120 to 125° C. for 3 to 5 minutes.

A double-sided adhesive tape or adhesive layer is formed on the carbon paste, a release paper is attached on the adhesive layer, current input terminals are connected in parallel, and silicone is coated thereon, thereby completing a manufacturing process of the planar resistance heating element.

The planar resistance heating element made using the above-described method has uniform heat conductivity and good heat-generating effect, thus can remove frost, ice and mist very quickly and efficiently. In particular, the planar resistance heating element can be effectively utilized in side mirrors of a car and the like.

Experimental Examples

Figure 3A:
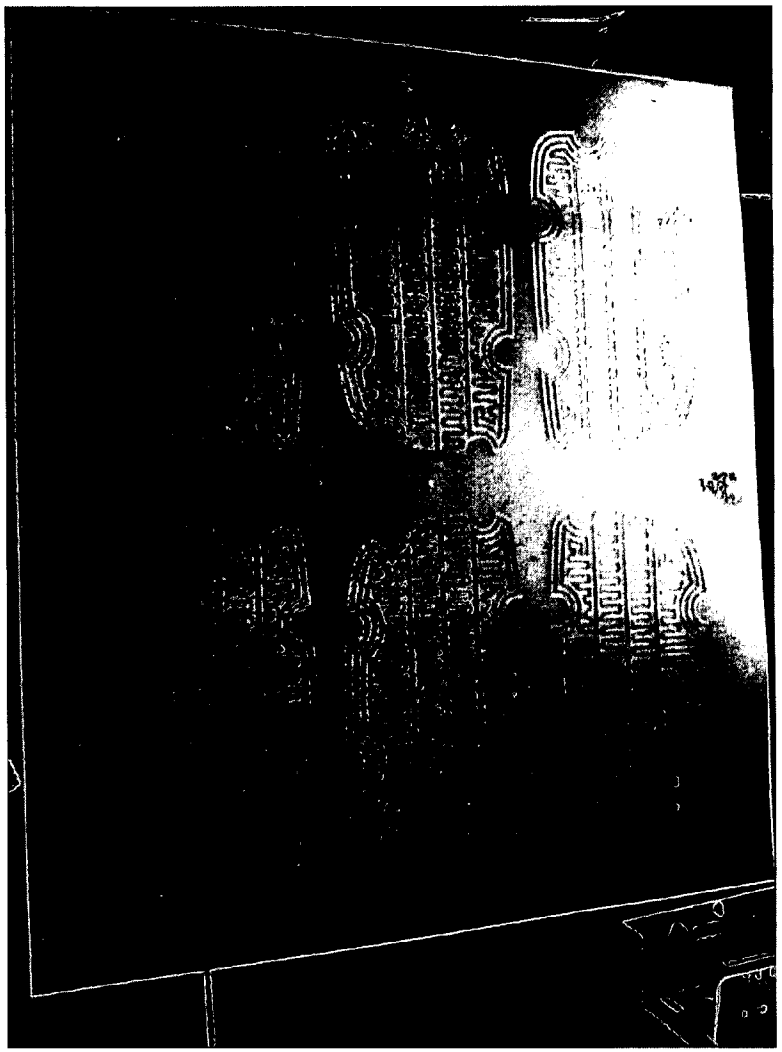
FIG. 3A is a photograph of an insulating substrate having an aluminum foil deposited thereon before drying in the case that the aluminum foil is not stepwise tempered.
Figure 3B:
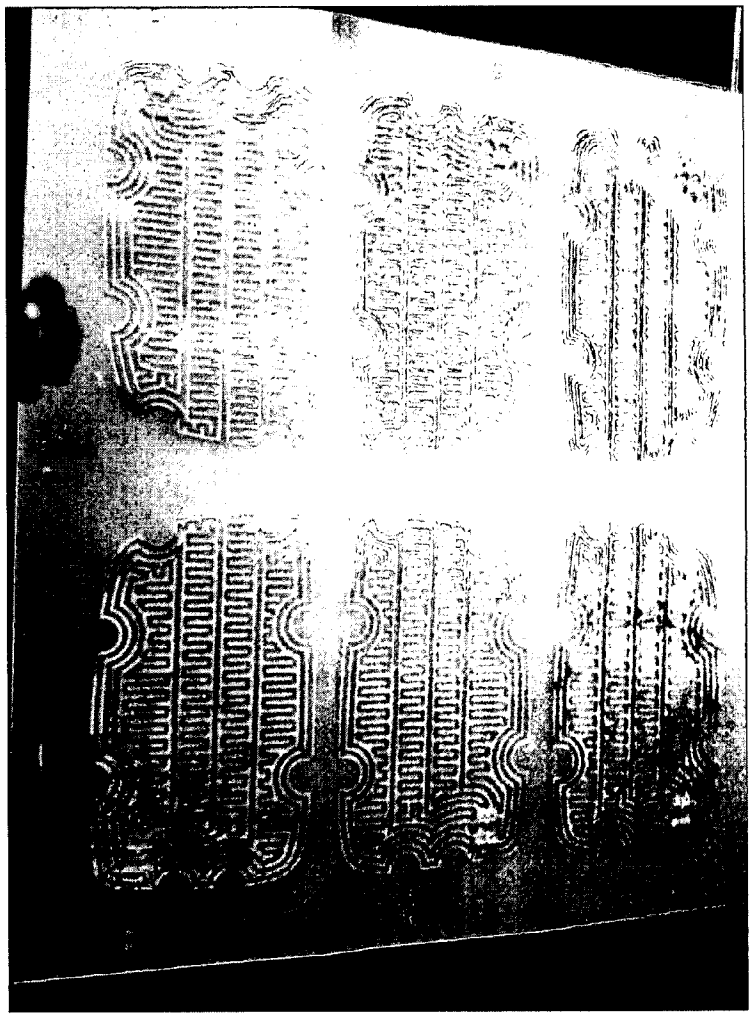
FIG. 3B is a photograph of the insulating substrate shrunken after drying.

In the planar resistance heating element of the present invention, the insulating substrate such as a PET film having the aluminum foil deposited thereon is adapted to undergo a multiple step tempering process to prevent heat deformation and to uniformly print carbon paste, leading to uniform heat conductivity. To demonstrate the effects of the present invention, a number of insulating substrates having aluminum foils deposited thereon are prepared under the same conditions described in the example embodiment section. Some of the insulating substrates having stepwise tempered aluminum foil are compared with others having non-tempered aluminum foil in terms of the degrees of shrinkage of the insulating substrates after drying. That is, according to the description of the example, an etch-resist is printed on 29 insulating substrates deposited with non-tempered aluminum foils (comparative examples 1 to 29) and UV-dried. In the same way, the etch-resist is printed on 5 insulating substrates deposited with stepwise tempered aluminum foils (examples 1 to 5) and UV-dried. The degree of shrinkage of an insulating substrate is measured by comparing the length thereof before drying with that after drying. Measurement results are summarized in Table 1. In addition, in the case that multiple step tempering is not performed, photographs of an insulating substrate having aluminum foil deposited thereon before and after drying are shown in FIGS. 3A and 3B, respectively.

TABLE 1

| | Degree of shrinkage of insulating substrates between before and after drying | | | | | |
|---|---|---|---|---|---|---|
| | Before Drying | | After Drying | | Shrinkage | |
| | width | length | width | length | width | length |
| example 1 | 420 | 370 | 420 | 370 | 0 | 0 |
| example 2 | 420 | 370 | 420 | 370 | 0 | 0 |
| example 3 | 420 | 370 | 420 | 370 | 0 | 0 |
| example 4 | 420 | 370 | 420 | 370 | 0 | 0 |
| example 5 | 420 | 370 | 420 | 370 | 0 | 0 |
| c. example 1 | 420 | 370 | 417 | 370 | −3 | 0 |
| c. example 2 | 420 | 370 | 416 | 370 | −4 | 0 |
| c. example 3 | 420 | 370 | 417 | 370 | −3 | 0 |
| c. example 4 | 421 | 370 | 417 | 370 | −4 | 0 |
| c. example 5 | 420 | 370 | 416 | 370 | −4 | 0 |
| c. example 6 | 420 | 370 | 416 | 370 | −4 | 0 |
| c. example 7 | 420 | 370 | 416 | 370 | −4 | 0 |
| c. example 8 | 420 | 370 | 416 | 370 | −4 | 0 |
| c. example 9 | 421 | 370 | 416 | 370 | −5 | 0 |

TABLE 1-continued

| | Degree of shrinkage of insulating substrates between before and after drying | | | | | |
|---|---|---|---|---|---|---|
| | Before Drying | | After Drying | | Shrinkage | |
| | width | length | width | length | width | length |
| c. example 10 | 420 | 370 | 416 | 370 | −4 | 0 |
| c. example 11 | 420 | 370 | 416 | 370 | −4 | 0 |
| c. example 12 | 420 | 370 | 416 | 370 | −4 | 0 |
| c. example 13 | 420 | 370 | 416 | 370 | −4 | 0 |
| c. example 14 | 420 | 370 | 416 | 370 | −4 | 0 |
| c. example 15 | 420 | 370 | 416 | 370 | −4 | 0 |
| c. example 16 | 420 | 370 | 416 | 370 | −4 | 0 |
| c. example 17 | 420 | 370 | 416 | 370 | −4 | 0 |
| c. example 18 | 420 | 370 | 416 | 370 | −4 | 0 |
| c. example 19 | 420 | 370 | 416 | 370 | −4 | 0 |
| c. example 20 | 421 | 370 | 416 | 370 | −5 | 0 |
| c. example 21 | 420 | 370 | 416 | 370 | −4 | 0 |
| c. example 22 | 421 | 370 | 416 | 370 | −5 | 0 |
| c. example 23 | 421 | 370 | 416 | 370 | −5 | 0 |
| c. example 24 | 420 | 370 | 416 | 370 | −4 | 0 |
| c. example 25 | 420 | 370 | 416 | 370 | −4 | 0 |
| c. example 26 | 420 | 370 | 417 | 370 | −3 | 0 |
| c. example 27 | 420 | 370 | 416 | 370 | −4 | 0 |
| c. example 28 | 420 | 370 | 416 | 370 | −4 | 0 |
| c. example 29 | 420 | 370 | 416 | 370 | −4 | 0 |

Unit: mm

As can be seen from Table 1, and FIGS. 3A and 3B, the insulating substrates deposited with stepwise tempered aluminum foils do not shrink even in the drying operation. In contrast, because the insulating substrates deposited with non-tempered aluminum foils shrink in the drying operation, the carbon paste, which is a resistor element, cannot be printed well, causing non-uniform heat conductivity and degrading functionality of planar resistance heating elements. Accordingly, to solve the above problems, an insulating substrate having aluminum foil deposited thereon is adapted to undergo a multiple step tempering process. Thus, heat deformation can be prevented, and the carbon paste can be uniformly printed, resulting in uniform heat conductivity.

As apparent from the above description, the present invention provides a manufacturing method of a planar resistance heating element and a planar resistance heating element made using the method, wherein an aluminum foil deposited on an insulating substrate is adapted to undergo a multiple step tempering process to thereby prevent heat deformation of the insulating substrate, and thus uniform heat conductivity, excellent heat-generation effect and easy manufacture can be achieved.

In addition, carbon paste acting as a resistor element is made of electrically conductive carbon, graphite, a resin, a solvent and a hardener which are mixed so as to optimize physical properties of the carbon paste, leading to good heat-generation effect and near-zero temperature variation.

Furthermore, low-resistance carbon paste and high-resistance carbon paste are mixed to produce a desired resistance, permitting easy selection of desired heat-generating properties.

What is claimed is:

1. A method for manufacturing a planar resistance heating element, said method comprising:

a) tempering an aluminum foil deposited on an insulating substrate in a stepwise manner at a temperature of 0 to 40 degree C. for 1.5 to 2.5 hours, thereafter at a temperature of 40 to 70 degree C. for 1.5 to 2.5 hours, thereafter at a temperature of 70 to 100 degree C. for 2.5 to 3.5 hours, and thereafter at a temperature of 100 to 130 degree C. for 14 to 18 hours;

b) then etching said aluminum foil in a desired pattern to make a planar resistance heating element; and c) then printing carbon paste and connecting input terminals in parallel to said heating element.

2. The manufacturing method of claim 1, wherein the tempered aluminum foil is cleaned using a cleansing solution of pH 10 to 12, and dried at a temperature of 50 to 65° C.

* * * * *